US010259256B2

(12) United States Patent
Nikkila

(10) Patent No.: US 10,259,256 B2
(45) Date of Patent: Apr. 16, 2019

(54) PROCESS FOR SECURING AN IDENTIFICATION DOCUMENT AND SECURE IDENTIFICATION DOCUMENT

(75) Inventor: Jarmo Nikkila, Meudon (FI)

(73) Assignee: GEMALTO SA, Meudon (FR)

( * ) Notice: Subject to any disclaimer, the term of this patent is extended or adjusted under 35 U.S.C. 154(b) by 321 days.

(21) Appl. No.: 13/318,146

(22) PCT Filed: Apr. 30, 2010

(86) PCT No.: PCT/EP2010/055912
§ 371 (c)(1),
(2), (4) Date: Oct. 30, 2011

(87) PCT Pub. No.: WO2010/125185
PCT Pub. Date: Nov. 4, 2010

(65) Prior Publication Data

US 2012/0049506 A1 Mar. 1, 2012

(30) Foreign Application Priority Data

Apr. 30, 2009 (EP) ..... 09159252

(51) Int. Cl.
*B42D 25/387* (2014.01)
*B42D 25/351* (2014.01)
(Continued)

(52) U.S. Cl.
CPC ..... *B42D 25/387* (2014.10); *B41M 3/144* (2013.01); *B41M 5/24* (2013.01); *B42D 25/00* (2014.10);
(Continued)

(58) Field of Classification Search
CPC ..... B42D 15/00; B42D 15/10; B42D 25/43; B42D 25/00; B42D 25/387; B42D 2035/24; G09C 3/00; B41M 3/144; B41M 5/24
(Continued)

(56) References Cited

U.S. PATENT DOCUMENTS 5,380,695 A * 1/1995 Chiang ..... B41M 3/14 283/109
5,543,381 A 8/1996 Kishimoto et al.
(Continued)

FOREIGN PATENT DOCUMENTS

DE 4339216 A1 4/1994
EP 0739677 A1 10/1996
(Continued)

OTHER PUBLICATIONS

PCT/EP2010/064447 International Search Report, dated Jan. 17, 2011, European Patent Office, P.B. 5818 Patenlaan 2 NL—2280 HV Rijswijk.
(Continued)

*Primary Examiner* — Justin V Lewis
(74) *Attorney, Agent, or Firm* — The Jansson Firm; Pehr B. Jansson

(57) ABSTRACT

The invention relates to a process for securing an identification document and to a secure identification document. More particularly, the process uses UV sensitive ink(s) to define a pattern only visible under UV radiations, by printing a first layer of a transparent ablation varnish (13), printing a layer (14) of UV sensitive ink(s) over said first layer of transparent ablation varnish, removing parts of the layer (14) of UV sensitive ink(s), by means of a laser beam, some remaining areas of said UV sensitive ink(s) defining said pattern to be revealed in color under UV radiations, and
(Continued)

some areas, where the UV sensitive ink(s) has been removed and the laser beam has interacted with the ablation varnish (13), absorbing the UV radiations with effect of creating black color. Other systems and methods are disclosed.

16 Claims, 2 Drawing Sheets

(51) Int. Cl.
*B42D 25/435* (2014.01)
*B42D 25/00* (2014.01)
*B41M 3/14* (2006.01)
*B41M 5/24* (2006.01)
*B42D 25/43* (2014.01)

(52) U.S. Cl.
CPC ..... *B42D 25/351* (2014.10); *B42D 25/43* (2014.10); *B42D 25/435* (2014.10); *B42D 2035/24* (2013.01)

(58) Field of Classification Search
USPC ..... 283/72, 74, 81, 85, 87, 89, 98; 427/7, 427/157, 553, 554, 555
See application file for complete search history.

(56) References Cited

U.S. PATENT DOCUMENTS

| | | | | |
|---|---|---|---|---|
| 5,895,074 | A * | 4/1999 | Chess et al. | 283/75 |
| 6,165,687 | A | 12/2000 | Reele | |
| 6,986,926 | B2 | 1/2006 | Fannasch et al. | |
| 7,198,302 | B1 | 4/2007 | Fannasch et al. | |
| 7,368,217 | B2 | 5/2008 | Lutz et al. | |
| 2003/0067157 | A1* | 4/2003 | McKillip | B44C 5/0407 283/62 |
| 2004/0245763 | A1* | 12/2004 | Trantoul | G09F 3/0292 283/72 |
| 2006/0141391 | A1 | 6/2006 | Klein et al. | |
| 2006/0249951 | A1* | 11/2006 | Cruikshank et al. | 283/92 |
| 2007/0166452 | A1* | 7/2007 | Levy | B42D 25/328 427/157 |
| 2008/0290648 | A1* | 11/2008 | Koops | C09J 7/0246 283/81 |
| 2009/0128615 | A1 | 5/2009 | Miller | |
| 2009/0212553 | A1* | 8/2009 | Herlin et al. | 283/85 |
| 2010/0025981 | A1* | 2/2010 | Lay | G06T 11/206 283/115 |
| 2010/0112223 | A1* | 5/2010 | Hill | B41M 3/008 427/259 |

FOREIGN PATENT DOCUMENTS

| | | | | |
|---|---|---|---|---|
| EP | 0776766 | B1 | 6/1997 | |
| EP | 0908901 | A | 4/1999 | |
| EP | 1129859 | A | 9/2001 | |
| EP | 1918123 | A1 | 5/2008 | |
| WO | WO03056500 | A | 7/2003 | |
| WO | WO2006025016 | A | 3/2006 | |
| WO | WO 2007051906 | A1 * | 5/2007 | |
| WO | WO2008031170 | A | 3/2008 | |
| WO | WO 2008084332 | A2 * | 7/2008 | B41M 3/008 |

OTHER PUBLICATIONS

PCT/EP2010/064447 Written Opinion of the International Searching Authority, dated Jan. 17, 2011, European Patent Office, P.B. 5818 Patenlaan 2 NL—2280 HV Rijswijk.

PCT/EP2010/055912, International Search Report, dated Feb. 15, 2011, European Patent Office, P.B. 5818 Patentiaan 2 NL—2280 HV Rijswijk.

PCT/EP2010/055912, Written Opinion of the International Searching Authority, dated Feb. 15, 2011, European Patent Offfice, P.B. 5818 Patentlaan 2 NL—2280 HV Rijswijk.

* cited by examiner

PROCESS FOR SECURING AN IDENTIFICATION DOCUMENT AND SECURE IDENTIFICATION DOCUMENT

BACKGROUND

This invention relates generally to identification documents and a method for making such identification documents. More particularly, this invention relates to a security feature for such identification document and to a secure identification document that allows detecting a fraudulent modification of the existing official personalization or a completely falsified document.

Identification documents are associated with secure applications, such as for example driving licenses, identity cards, membership cards, badges or passes, passports, discount cards, banking cards, money cards, multi-application cards, and other papers of value; and security documents such as bank notes. Such documents are widely used, they may comprise an electronic module or not. If they comprise an electronic module, they can function either with contact and/or without contacts depending on the application to which they are intended. They may take the shape of card or a booklet or something else. Such identification documents are graphically personalized. Personalized information is personal data of the card's owner, i.e for example his photo, his name, his birth date, his social security number, his biometric information such as his fingerprint for example, a validity date, an identification number allocated to him etc. . . . . This personalized information is printed onto the surface of the document, or into one or more constitution layers of the document. Because of the value and importance associated with each of these data carriers, they are often the subject of unauthorized copying and alterations, and forgeries.

To prevent such activities from being carried out on these data carriers, different types of visual and touchable security features have been added to data carriers. One of these security features consists in printing UV fluorescent inks, by ink jet printing technology for example, for drawing a security pattern, which is not visible to naked eyes under daylight radiations, but which appears under UV radiations as a colored image and/or text because they fluoresce with visible light when illuminated with UV light. Such security feature using UV fluorescent inks is widely used now, but it is only used as a background printing, so that it is impossible to personalize it. Moreover, with inkjet printers, one can use fluorescent inks, in order to print for example facial image only visible under UV light making each document specific to the document holder. However, the number of colors/inks is limited and typically, only one UV ink can be used, its color being for example red, blue or yellow. Consequently, forgers can also obtain the same effect by using the same ink and a relatively low cost printer.

Considering the above, a problem intended to be solved by the invention, is to propose a process for securing an identification document by using UV sensitive ink(s) to define a pattern only visible under UV radiations, i.e. UV absorbing without absorbing also the visible radiations, said process being easy to implement, so that it does not involve over costs, and enabling to obtain an enhanced security feature, which achieves an effect that is impossible to reproduce in a simple manner.

SUMMARY

The solution of the invention to this problem relates to the fact that the process comprises the following steps:

printing a first layer of a transparent ablation varnish, printing a layer of UV sensitive ink(s) over said first layer of transparent ablation varnish, removing parts of the layer of UV sensitive ink(s), by means of a laser beam, some remaining areas of said UV sensitive ink(s) defining said pattern to be revealed in color under UV radiations, and some areas, where the UV sensitive ink(s) has been removed and the laser beam has interacted with the ablation varnish (13), absorbing the UV radiations with effect of creating black color.

A first advantage to use of the transparent ablation varnish, relates to the fact that the UV sensitive inks are not burned by the laser beam, so that no black traces appear around the removed areas under daylight. A second advantage relates to the fact that the image actually revealed under UV light comprises two things. First, the remaining UV ink is visible in color under UV light. Second, in the areas where the ink has been removed but not the transparent ablation varnish, the laser beam interacts with the ablation varnish, and leads to absorption of the UV radiations, with the effect of creating black color, while those areas appear invisible under visible light. This unexpected additional effect has never been obtained before because when color UV sensitive inks are used, they always produce only single color images or, at best, a color picture. This effect cannot be mimicked by simply ink jet printing UV sensitive ink without the varnish layer.

According to another aspect, the invention relates also to a secure identification document comprising a pattern made with UV sensitive ink(s) so that it can only be revealed under UV radiations. This secure identification document is remarkable by the fact that it comprises:

a layer of a transparent ablation varnish that is provided under a layer of said UV sensitive ink(s), said pattern being defined into and through the layer of UV sensitive ink(s) by means of a laser beam.

BRIEF DESCRIPTION OF DRAWINGS

Other particularities and advantages of the invention will be better understood with the help of the description below, which has been provided as an illustrative and non limitative example by reference to the enclosed figures that represent.

DETAILED DESCRIPTION

Hereafter, an embodiment of the present invention will be described in the context of identity (ID) card and a method for producing it. However, it is to be understood that the invention is usable with any data carrier that includes, but is not limited to, a driving license, a badge or pass, a passport, a discount card, a membership card, a banking card, a credit card, a money card, a multi-application card, and other security documents and papers of value that are to be provided with information or data in such a way that they cannot be easily imitated by common means. Such identification documents may take indifferently the shape of card, or booklet, or something else, and can be made either with plastic material or with paper.

Figure 1:
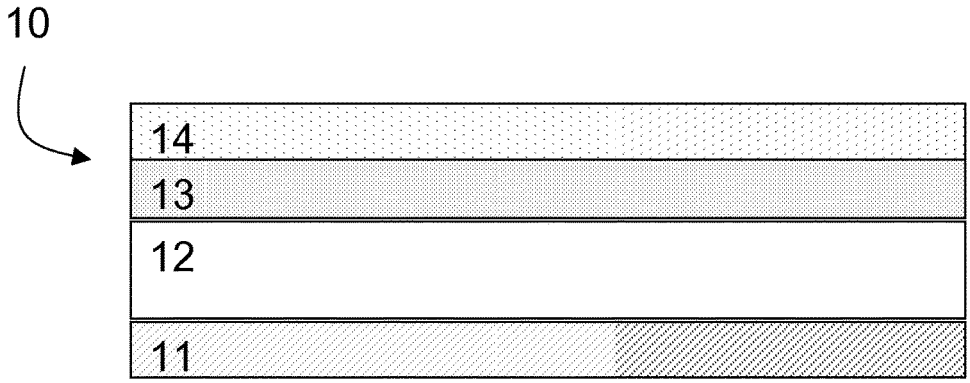
FIG. 1, is a schematic cross-sectional view of an identification document according to a first embodiment.

FIG. 1 shows a schematic cross-sectional view of an identification card 10 according to a first embodiment. This card comprises a core layer 11, which can be made either in plastic material or in paper. The plastic material can be a conventional material used in cards technology, such as PVC, or PET, or PVC/PET, or PC. Moreover, this core layer 11 can be either opaque, for example white, or at least translucent. If the core layer 11 is opaque, another layer 12, at least translucent and at the most transparent, can be preferably added for the reasons explained in more details further below. Then, a transparent ablation varnish 13 is applied either onto the whole surface of the at least translucent portion 12, or only on area(s) intended to be personalized/marked with a laser beam. The varnish used is for example the varnish known under the trademark "Vynaglaze" silk screen varnish, serie 47, more particularly Vynaglaze varnish referenced DDP 1846/47, which is sold by the company Sun Chemical. This varnish is very interesting because it exhibits good intercoat adhesion, excellent durability, while interacting with laser beam, so that the thus interacted material absorbs UV radiations leading to the creation of black color, while remaining invisible under visible light.

Then, a layer 14 of fluorescent ink, or mixture of fluorescent inks, is printed onto the varnish layer 13. The fluorescent ink(s) can be UV sensitive inks that are visible only when activated by at least one predetermined UV wavelength, such as 365 nm for example. The layer 14 of fluorescent ink(s) is printed by any conventional process, such as ink jet, silkscreen process, or offset for example.

In order to achieve an optimum effect, indeed to view the engraved pattern, with a good contrast and luminosity, only when enlighten the document with a predetermined radiation, the thicknesses of each of the layers 13 of varnish and 14 of fluorescent ink(s) have to be sufficient but not too thick. Consequently, the thickness of transparent ablation varnish 13 is applied using silk screen printing process, with a thickness comprised between 5 and 24 μm, and preferably between 6 and 12 μm. The fluorescent ink(s) layer 14 is printed using offset process until the obtained layer is typically around 1.4 and 2 $g/m^2$.

Then, the fluorescent ink(s) layer 14 is engraved, by using a laser beam, in such a manner that only some areas of the ink layer remain, so as to draw the security pattern to be revealed under predetermined wavelength, for example UV wavelength. The laser beam used for such engraving is preferably an infrared YAG laser. This infrared YAG laser could also be replaced by lasers working in invisible or UV wavelength range or by fiber laser. If such lasers are used, a low power has to be used to be in the same spot energy range than the infrared YAG laser. Such laser engraving does not let any visible signs on the document, and the remaining pattern will be visible only under UV light. Generally, such laser engraving would have burn the ink layer around the removed parts, so that visible black traces would have appeared under normal daylight, around the pattern to be revealed. However, this is not the case in the present invention, due to the use of the transparent ablation varnish 13, which enables not to burn the ink layer, so that no visible burning traces appear under daylight when the pattern is made by laser engraving the ink layer.

Another advantage to use the transparent ablation varnish 13 relates to the fact that the obtained effect is very surprising and unexpected. Indeed, the pattern, drawn by laser engraving the fluorescent ink(s) 14 layer above the transparent ablation varnish 13, appears as a mixed image, which appears with colored and grayscale areas, only when enlighten under a predetermined UV light, despite the fact that UV color inks are used. In fact, the resulting image is not only gray scale because the unablated parts fluoresce with some visible color. This color gives colored contrast to the gray scale image created with the laser. This unexpected additional effect has never been obtained before because when color UV sensitive inks are used, they generally produce only single color images or, at best, a color picture. This effect cannot be mimicked by simply ink jet printing an UV sensitive ink without the varnish layer.

As it has been already described, the transparent ablation varnish together with the fluorescent ink(s) are preferably printed onto an at least translucent portion, and at the most transparent. This is because, with such a structure, the pattern is surely invisible under daylight. If the varnish and fluorescent ink(s) are printed onto an opaque layer, for example a white layer, then, some time to time, the engraved pattern could become a bit visible under daylight.

The document according to this embodiment may further comprise a protective film (not shown), which is applied onto the fluorescent ink(s) layer 14, in order to protect it against environmental stresses, which can be mechanical or chemical for example. The protective film can be of different kinds. It can be a protective plastic layer made of PVC or PET or PC, which is laminated onto the whole surface of the document, and having a thickness lying between 50 and 150 μm. Such a protective layer is also called overlay. Another form of protective layer, also called patch or reinforced protective film, consists in a plastic film generally made of PET, that is pre-pasted and having a thickness comprised between 10 and 25 μm. Such a film is sufficiently robust for resisting to environmental stresses during several years.

Such protective film, either in the form of an overlay or in the form of a patch, can be applied onto the surface of the document in a last step, just after the laser engraving step for drawing the pattern to be revealed.

Figure 2:
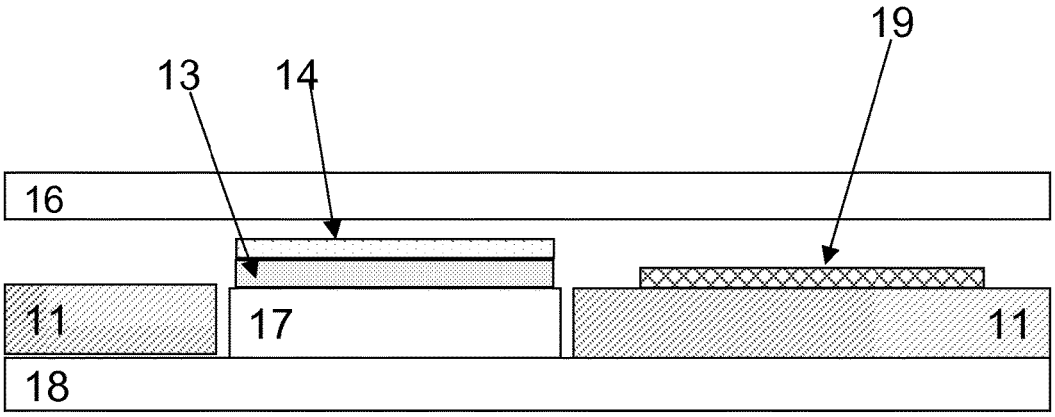
FIG. 2, is a schematic cross-sectional view of an identification document according to a second embodiment, FIGS. 3A and 3B, front views of an ID card holding official personal information of its regular holder, respectively under daylight radiations and under UV radiations.

FIG. 2 shows schematic cross-sectional view of another document according to a second embodiment. The main difference compare to the first embodiment relates to the fact that the document comprises only a portion 17 that is at least translucent and at the most transparent. This portion 17 defines a see-through portion into the opaque body 11 of the document. Then, the transparent ablation varnish 13 and the fluorescent ink(s) 14 are applied only onto the surface of this see-through portion 17. The thicknesses of these layers 13, 14 are small enough, and the further lamination of a protective film such as an overlay 16 enables to avoid a visible over-thickness onto this portion. As it has been previously described for FIG. 1, the laser engraving step of the fluorescent ink(s) 14 can be made before laminating an overlay 16 or attaching a patch 16 onto the document. Another overlay or patch 18 can also be fixed on the other side of the document for example. Other parts of the opaque body 11, or another intermediate layer, not showed, can be covered by other inks that are visible under daylight for printing some official information 19, such as personal information linked to the true holder of the document for example. Such personal information can also be printed by laser engraving through the overlay, provided that the layer 11, into which the laser-engraving is made, is laser-sensitive.

Figure 3A:
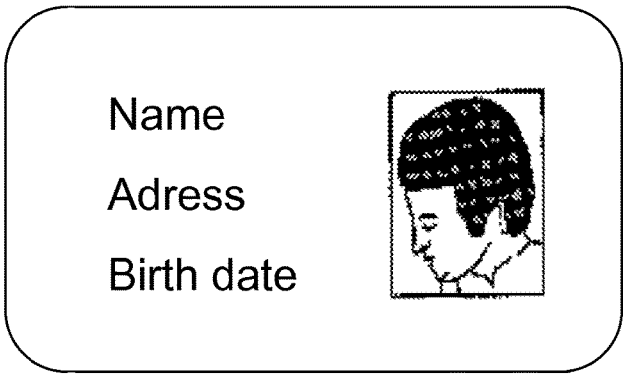
Figure 3B:
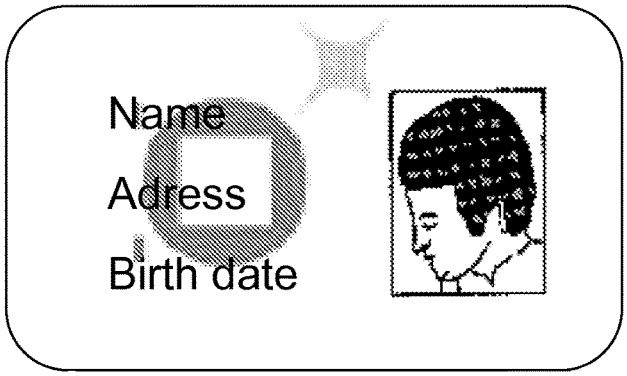

FIGS. 3A and 3B show a schematic front view of an ID card holding for example personal information that is linked to its regular holder. FIG. 3A is enlightened under daylight and nothing more can be viewed other than official information provided in a visible manner on the card. FIG. 3B shows the same card enlightened under UV radiations, which reveals the apparition of other information, such as logo in the schema of FIG. 3B, which appears to be a combination of fluorescing areas and a gray scale image. Of course, the colored and grayscale information that can be viewed under UV radiations can be of different kind, such as logo, textual information that can be linked to personal information of the holder, and/or photography of the holder for example. Such image being obtained by laser engraving of the fluorescent ink(s) layer, all type of information can be drawn with a very high precision.

The invention is not limited to the embodiments that have been described and other variants can be made without departing the scope of the invention. Thanks to the use of the transparent ablation varnish, it is possible to achieve an effect that has never been reached before. Indeed, first the laser-engraving step does not let any visible traces around the removed ink, and second the drawn pattern that appears only under UV radiations consists in a mixed image, which is a combination of fluorescing areas and a gray scale image.

The invention claimed is:

1. A method of manufacturing a secure identification document comprising a pattern made with UV fluorescent ink(s), whereby the pattern can only be revealed under UV radiations, the method comprising:

depositing a layer (13) of a transparent ablation varnish on a portion of a substrate, the ablation varnish having a first side facing the substrate and being a varnish that becomes absorbent of UV radiation as a result of exposure to a laser;

printing a layer (14) of UV fluorescent ink(s) over said layer (13) of transparent ablation varnish on a second side of said layer of transparent ablation varnish that is opposite to the first side; and engraving said pattern into and through the layer (14) of UV fluorescent ink(s) by exposing the ablation layer to a laser beam, whereby said pattern comprises a mixed image formed from a combination of:

UV fluorescing and grey scale areas, respectively, in areas not engraved by the laser beam for which the UV radiations make visible the UV fluorescent ink and is not absorbed by the transparent ablation varnish, and in areas engraved by the laser beam for which the UV fluorescent ink is ablated and the transparent ablation varnish below absorbs the UV radiations.

2. The method of manufacturing a secure identification document according to claim 1, wherein the layers of transparent ablation varnish (13) and UV fluorescent ink(s) (14) are applied onto an at least translucent portion (17) of said substrate.

3. The method of manufacturing a secure identification document according to claim 1, further comprising a translucent layer (12) between said substrate and said layer of transparent ablation varnish.

4. The method of manufacturing a secure identification document according to claim 2, wherein said at least translucent portion defines a see-through portion (17) through the document.

5. The method of manufacturing a secure identification document according to claim 1, wherein said substrate is an opaque paper layer.

6. The method of manufacturing a secure identification document according to claim 1, wherein the layer of transparent ablation varnish (13) has a thickness comprised between 5 and 24 μm.

7. The method of manufacturing a secure identification document according to claim 1, wherein the layer of UV fluorescent ink(s) (14) has a density between 1.4 and 2 g/m$^2$.

8. A method of manufacturing a secure identification document which is customizable to include a pattern produced by exposure to a laser and the pattern visible when exposed to UV radiation and the pattern not revealed to visible light, the method comprising:

depositing a layer of a transparent ablation varnish on a substrate, the layer of transparent ablation varnish having a first side facing the substrate and a second side opposite to the first side, the transparent ablation varnish being absorbent of UV radiation as a result of exposure to a laser, the transparent ablation varnish further having a property of protecting the document from turning black when exposed to a laser thereby preventing occurrence of black outlines around patterns formed in said layer of UV fluorescent ink by laser engraving; and printing a layer of UV fluorescent ink(s) over said layer of transparent ablation varnish adjacent to the second side;

whereby when exposed to a laser beam, patterns are defined into and through the layer (14) of UV fluorescent ink(s), said patterns comprise a mixed image formed from a combination of:

(a) UV fluorescing and (b) grey scale areas, respectively, (a) in areas not engraved by the laser beam for which UV radiations make visible the UV fluorescent ink and is not absorbed by the transparent ablation varnish, and (b) in areas engraved by the laser beam for which the UV fluorescent ink is ablated and the transparent ablation varnish below absorbs the UV radiations.

9. The method of manufacturing a secure identification document according to claim 8, wherein the steps of depositing layers of transparent ablation varnish and UV fluorescent ink(s) comprise depositing the transparent ablation varnish and UV fluorescent ink(s) onto an at least translucent portion of the substrate.

10. The method of manufacturing a secure identification document according to claim 8, further comprises placing a translucent layer between said substrate and said layer of transparent ablation varnish.

11. The method of manufacturing a secure identification document according to claim 8, wherein said at least translucent portion defines a see-through portion through the document.

12. The method of manufacturing a secure identification document according to claim 8, wherein said substrate is an opaque paper layer.

13. The method of manufacturing a secure identification document according to claim 8, wherein the layer of transparent ablation varnish (13) has a thickness comprised between 5 and 24 μm.

14. The method of manufacturing a secure identification document according to claim 8, wherein the layer of UV fluorescent ink(s) (14) has a density between 1.4 and 2 g/m$^2$.

15. A method of manufacturing a security document suitable for customization by exposure to laser such that areas exposed to a laser are transparent in visible light and display gray scale coloring in UV light whereas areas not exposed to a laser are transparent in visible light and UV fluorescent in UV light, the method comprising:

depositing a layer of a transparent ablation varnish on a portion of said substrate, the layer of transparent ablation varnish having a first side facing the substrate, the transparent ablation varnish being an ablation varnish that becomes absorbent of UV radiation as a result of exposure to a laser; and depositing a layer of UV fluorescent ink(s) printed over said layer of transparent ablation varnish on a second side of said layer of transparent ablation varnish that is opposite to the first side.

16. A method of manufacturing a security document suitable for customization by exposure to laser such that areas exposed to a laser are transparent in visible light and display gray scale coloring in UV light whereas areas not exposed to a laser are transparent in visible light and UV fluorescent in UV light, the security document comprising:

depositing a layer of a transparent ablation varnish on a portion of a substrate, the layer of transparent ablation varnish having a first side facing the substrate, the transparent ablation varnish being an ablation varnish that becomes absorbent of UV radiation as a result of exposure to a laser, said layer of transparent ablation varnish comprising a first area that is activated thereby displaying black coloring when exposed to UV light and a second area that is not activated thereby remaining transparent when exposed to UV light; and depositing a layer of UV fluorescent ink(s) printed over said layer of transparent ablation varnish on a second side of said layer of transparent ablation varnish that is opposite to the first side.

* * * * *